US005526915A

United States Patent [19]

Bessette et al.

[11] Patent Number: 5,526,915

[45] Date of Patent: Jun. 18, 1996

[54] SAFETY SWITCH ASSEMBLY

[75] Inventors: Brian P. Bessette, Colchester; William T. Guyette, Burlington, both of Vt.

[73] Assignee: Custom Controls, Inc., Williston, Vt.

[21] Appl. No.: 401,990

[22] Filed: Mar. 10, 1995

Related U.S. Application Data

[63] Continuation-in-part of Ser. No. 85,725, Jul. 6, 1993, Pat. No. 5,415,263.

[51] Int. Cl.[6] ..... H01H 3/02

[52] U.S. Cl. ..... 192/130; 192/129 A; 200/61.85; 307/143

[58] Field of Search ..... 192/129 A, 129 R, 192/130; 200/61.85, 332.2; 307/143

[56] References Cited

U.S. PATENT DOCUMENTS

| | | | |
|---|---|---|---|
| 2,512,089 | 6/1950 | Cervin | 200/61.85 X |
| 2,794,523 | 6/1957 | Cortelli et al. | 192/129 A X |
| 3,986,281 | 10/1976 | Darwin | 192/130 X |
| 4,203,101 | 5/1980 | Towsend | 200/61.85 X |
| 4,487,305 | 12/1984 | Wagner | 192/129 A |
| 4,647,738 | 3/1987 | Diamond | 200/81 H |
| 4,839,533 | 6/1989 | Aga | 192/129 A X |

*Primary Examiner*—Richard M. Lorence
*Attorney, Agent, or Firm*—Thomas N. Neiman

[57] ABSTRACT

The safety switch assembly is designed to provide a switch assembly to a tool, such as a meat slicer, in order to prevent the operation of the tool without manually holding the pressure sensitive safety handle. The assembly contains a control box having a ground fault interrupter/on-off switch, signal device, a power receptacle and a control circuit. A safety handle is installed on the tool and the handle has two pressure sensitive strips which function as a dual force sensing resistor and is connected to an electric cable that connects the safety handle to the control box which houses the control circuit. The operation of the tool requires that power be supplied to the control box. When the individual grips the safety handle and squeezes the handle, the control box provides power to the tool itself.

5 Claims, 4 Drawing Sheets

SAFETY SWITCH ASSEMBLY

This is a continuation-in part application of application Ser. No. 08/085,725 filed on 6 Jul. 1993 now U.S. Pat. No. 5,415,263.

BACKGROUND OF THE INVENTION

This invention pertains to power tools, and, in particular, to a safety switch assembly it is designed to be used with power tools such as meat slicers, and the like, in order to protect the user from the tool from being activated accidentally when the hands of the user are not in the proper position to keep the user from being injured.

There are a number of safety switches on the market today. Most of them are small switches on the handle of a power tool which allows the user to physically squeeze the power switch or trigger. In other words, the power switch or trigger cannot be squeezed until the safety switch is pressed in.

Clearly, it is desirable for an apparatus of this type to be very lightweight and flexible. At the same time, the apparatus should be easy to install and be extremely simple to attach to power tool, such as a meat slicer, and at the same time be very effective. It is the nature of a meat slicer that requires the user to place the meat against the slicer knife. One hand slides the carriage back and forth to cut the meat and rests on the tool handle. The other hand is used to catch the product being sliced. An object of this invention is to provide an assembly that has an ease of manufacture and ease of assembly. It is another object of this invention to teach an assembly that will require the user to have his or her hands in the proper position to avoid injury when using the power tool. It is an object of this invention to set forth an improved safety switch assembly which avoids the disadvantages, limitations, above-recited, obtained from safety switches.

SUMMARY OF THE INVENTION

It is also the object of this invention to teach a safety switch assembly which is simple to install and use and that will enable the operator to easily operate and will provide optimum efficiency and safety. Particularly, it is the object of this invention to set forth a safety switch assembly, for use with power tools, comprising a control housing; said control housing further having an on-off power control switch on said control housing; said control housing having ground fault circuit interrupting means; said control housing further having apparatus control circuit means within said control housing; said control housing further having electrical power control means for permitting power to be directed from the electrical source to said power tool; handle means; said handle means having two force sensing resistors for detecting hand pressure and allowing electrical current to flow to said control circuit means; said two force sensing resistors comprising variable resistance means for controlling said electrical current to flow from said handle means to said electronic control circuit means in said control housing which in turn permits electrical power to proceed through said electrical power control means to said power tool; said handle means further having an electrical cable; and said electrical cable having means connecting said handle means to said control housing.

BRIEF DESCRIPTION OF THE DRAWINGS

Further objects and of this invention will become more apparent by reference to the following description taken in conjunction with the accompanying figure, in which.

DETAILED DESCRIPTION OF THE PREFERRED EMBODIMENT

Figure 1:
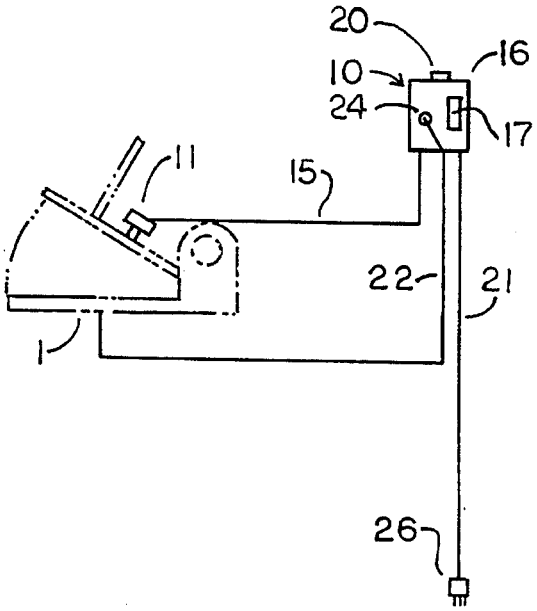
FIG. 1 is a reduced sized perspective view of the entire assembly.
Figure 2:
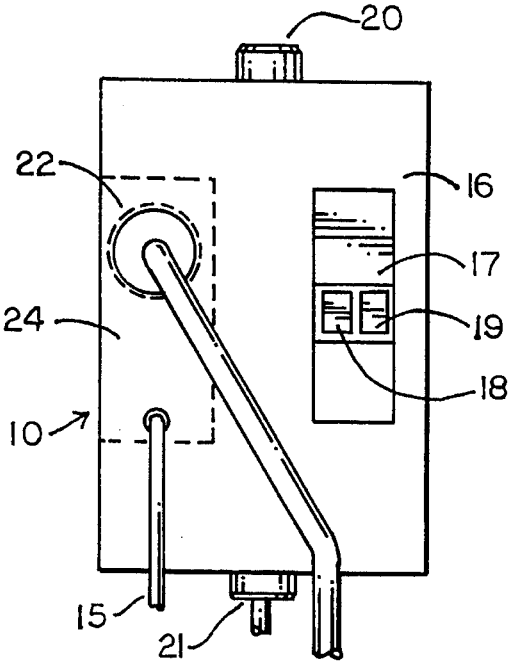
FIG. 2 is a front elevational view of the control box of the novel assembly.
Figure 3:
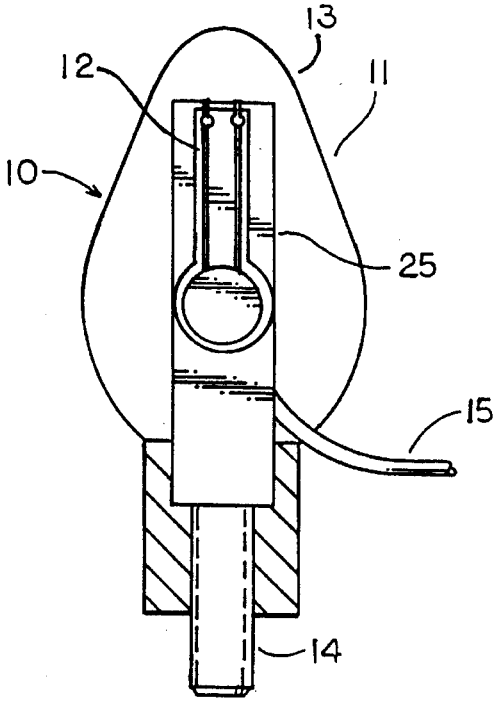
FIG. 3 is an enlarged cross sectional view of the handle and dual sensing means.

As shown in the figures, the novel safety switch assembly 10 is comprised of a handle 11. The handle 11 has an upper egg shaped section 13 made of resilient materials and a lower portion 14 which is a rod like projection and has a threaded base to be attached to a base section. The handle 11 has two force sensing resistive strips 12 and 12*a* mounted on the stem 25. These two resistive strips 12 and 12*a* allow electrical current to flow in the electrical cable 15 to the control circuit 24. Both strips must be pressed 12 and 12*a* to allow the control circuit 24 to turn on the power control switch and allow power to go to the tool. The other main part of the system is the control box 16 that contains a ground fault circuit interrupter 17 for electrical safety purposes. Additionally, the Control box 16 has an interconnected on-off switch 18 and 19, which can be a part of the ground fault interrupter 17, and a signal device 20 which indicates to the operator that the safety switch assembly is ready for operation. It also has an electronic control circuit 24. The control box 16 has an incoming power supply line 21 coming in from the power source 26, a power receptacle 22 to power the tool or appliance 1 being operated, and an electrical cable 15 coming in from the safety switch handle. When electrical current comes through the electrical cable 15 as the two force sensing resistive strips 12 and 12*a* are squeezed, the electrical control circuit 24 in the control box 16 energizes the control relay permitting power to be advanced to the appliance or tool.

Figure 4:
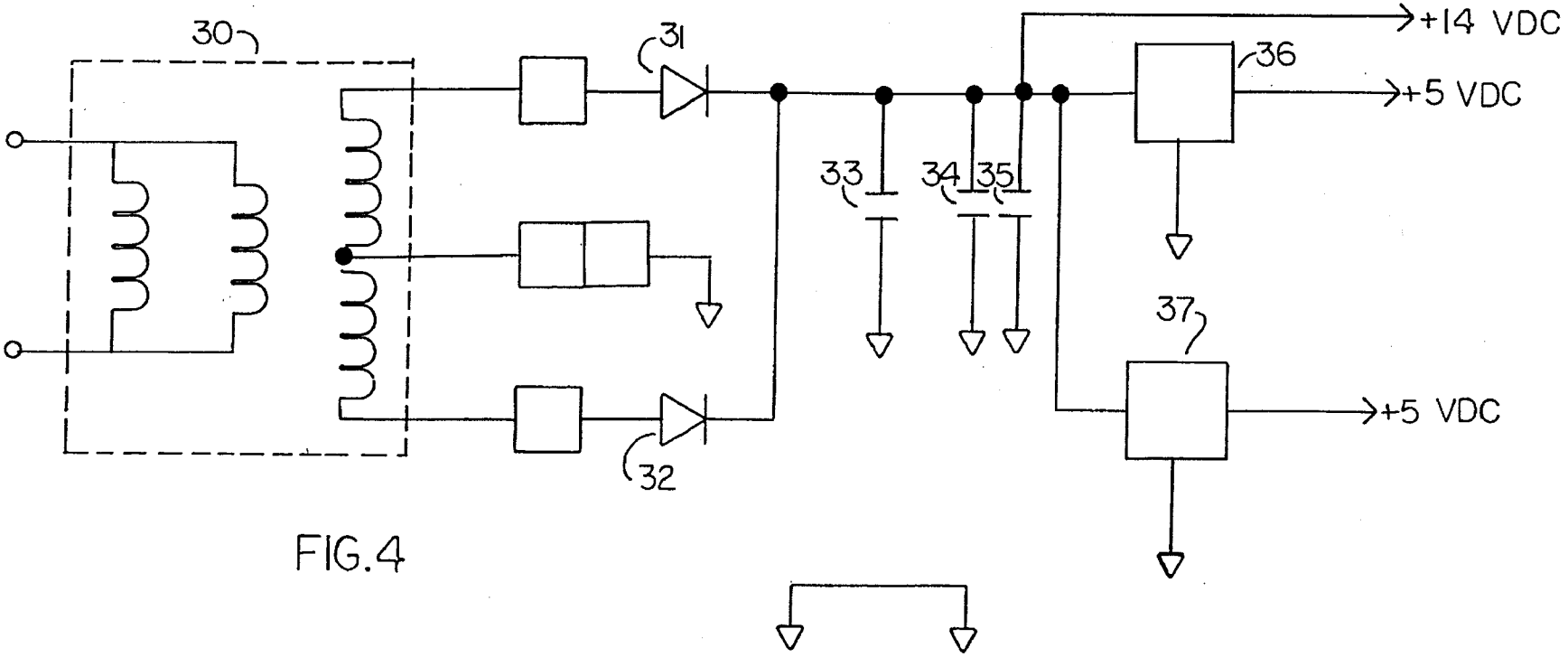
FIG. 4 is a schematic view of the novel circuitry in the power supply section.
Figure 5:
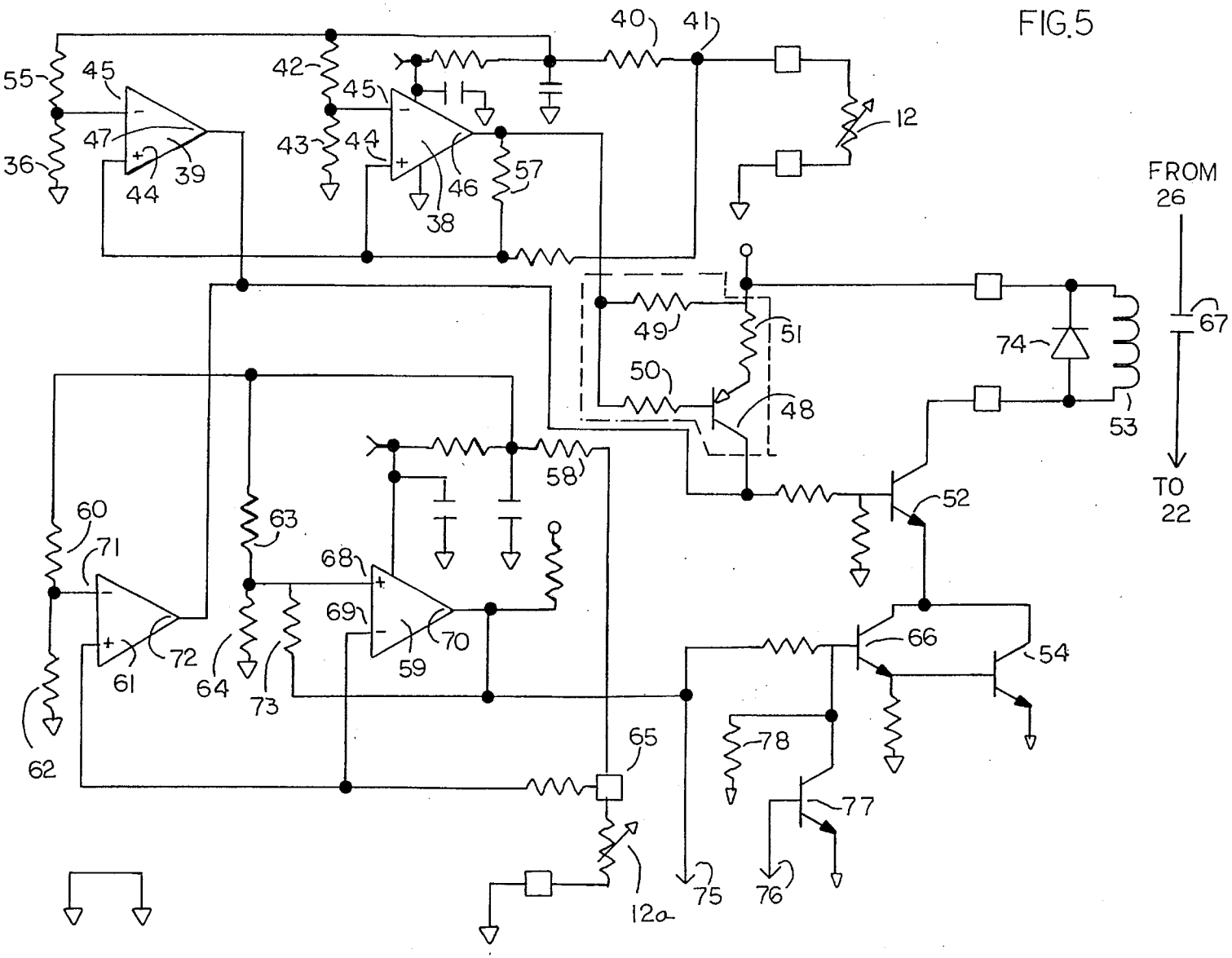
FIG. 5 is a schematic view of the novel circuitry in the variable resistance system.
Figure 6:
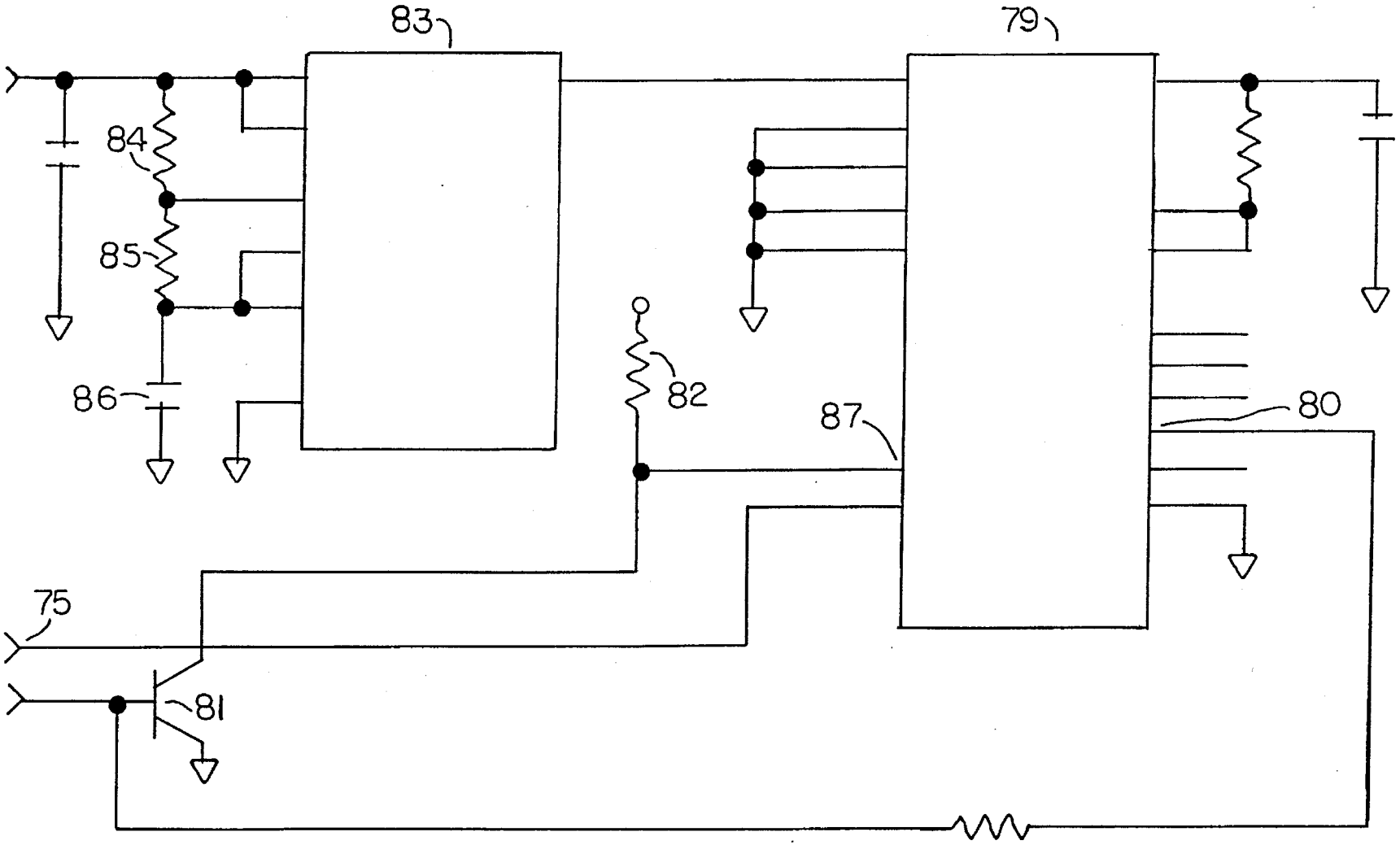
FIG. 6 is a schematic view of the novel circuitry in then time delay system.

FIGS. 4 through 6 show the electrical schematics of the assembly. The power supply section of the slicer switch is shown in FIG. 4. The 115 volt AC input power is stepped down to ten volts by transformer 30. This voltage is full wave rectified by diodes 31 and 32, and filtered by capacitors 33, 34 and 35 to provide approximately fourteen volts of unregulated DC power. This unregulated power is regulated into two five volt outputs for use by the two independent sensing circuits, using the two triple terminal regulators 36 and 37. FIG. 5 shows the dual sensing system. The interface to each of the two resistive pressure transducers uses similar circuitry. A dual precision voltage comparator 38 and 39 is used to interface with sensor 12. The sensor is excited by the +5 volt number one supply 36, the sensor resistance 12 and the excitation resistor 40 form a voltage divide at the node 41. This voltage appears at the non-inverting terminal 44 of both of the precision voltage comparators 38 and 39. This voltage is compared to the voltage generated by the resistive voltage divider 42 and 43 which is applied to the inverting terminal 45 of the voltage comparator 83. Normally, the sensor 12 is a high resistance so the voltage at node 41 exceeds that generated by the voltage divider 42 and 43. Under these conditions, the output on pin 46 of the voltage comparator 38 is a high impedance which causes the transistor switch consisting of transistor 48 and resistors 49, 50 and 51 to be in a high impedance of an off state. This prevents base current from flowing to transistor 52. Under these conditions transistor 52 does not allow current to flow in the relay coil 53 and the power output of the assembly 10 is in the off state. When pressure is applied to the sensor 12, its resistance drops sufficiently for the voltage at node 41 to drop below that generated by the voltage divider 42 and 43. When this occurs the output pin of the voltage comparator 38 sinks sufficient current to turn on transistor switch 48 which will provide base current to transistor switch 52. This will activate the relay coil 53 and turn on the power output of the assembly 10 if transistor 54 is also on. If the resistance of sensor 12 drops too low, the voltage at node 41 will drop below that generated by voltage divider 55 and 56. When this occurs the output pin 41 of the voltage comparator 39 sinks current preventing the activation of transistor 52 this prevents the power output of the assembly 10 to turn on in the event of a short circuit. Resistor 57 provides hysteresis to prevent oscillation of the output when the transducer resistance is near the trip point.

Sensor 12*a* is excited by the second five volt supply 37. The sensor resistance 12*a* and the resistor 58 form a voltage divider. This voltage is applied to the non inverting input 68 of one section of the precision voltage comparator 59, and to the inverting input 71 of the other section 60. This voltage is compared to the voltages developed by resistive dividers 61, 62 63 and 64. Normally the sensor 12*a* is a high resistance so that the voltage at node 65 will exceed the outputs of the two voltage dividers. In this case, the output pin 70 of the voltage comparator 59 will Slink current preventing base current from flowing to transistor 66, which will prevent base current from flowing to transistor 54 which will keep the relay coil 53 and contact 67 from activating the output to the tool or slicer. When pressure is applied to the sensor 12*a*, its resistance will drop causing the voltage at node 65 to decrease causing the voltage at the non inverting terminal 68 to exceed that at pin 69. This will cause the output pin 70 of the voltage comparator 59 to go high turning on transistors 66 and 54. The relay 53 will be activated if transistor 52 is also on. If the resistance of sensor 12*a* drops too low, the voltage at the inverting input pin 71 will exceed that at node 65. This will cause the output pin 71 of the voltage comparator 60 to sink current preventing the activation of transistor 52 and prevents the relay 53 from activating the output. Resistor 73 provides hysteresis to prevent oscillation when the sensor 12*a* is near its trip point. Diode 74 is used to suppress transient voltage during the turn off of the relay coil 53. The relay contact 67 is used to provide a high current output drive to the slicer or tool. Coil power is supplied by the unregulated power supply. Control signals 75 and 76 are used to interface to the timing delay circuit. When control signal 75 is at a logic 1, it allows transistor 66 to be turned on. When control signal 75 is at a logic "0" transistor 66 is off, control signal 76 prevents turn on when at logic 1, by turning on transistor 77 which prevents base current from flowing into transistor 66. Resistance 78 is used to pull the base of transistor 66 to ground in order to prevent turn on due to leakage currents.

FIG. 6 shows the time delay circuit. A square wave oscillator is formed by timer 83 and resistance 84 and 85 and capacitor 86 with a period of forty five seconds and is fed to a binary counter 79. The binary counter 79 is configured to count up to eight and then stop unless it is reset. This is accomplished by tying the output of the binary counter 80 to the input 87 through an invertor made from transistor 81 and resistor 82. When the input 87 is high, the counter is disabled and its output will remain unchanged until reset, control signal 76 is also high which disables the output by activating transistor 77. The binary counter 79 is cleared any time the control signal 75 goes low. Since control signal 75 goes low anytime pressure is released from sensor 12*a*. This logic provides a maximum of on time of approximately six minutes, since after that amount of time the binary counter 79 will have counted up to its predetermined terminal value of eight, which can be adjusted by selection of other outputs of binary counter 79.

Alternate embodiments for the assembly would include the use of an electronic or mechanical brake mechanism which can be used to ensure complete stoppage of the blade as quickly as possible. Also, it would be possible to provide a secondary plate actuator to be positioned in series with the electrical cable between the handle and the control box or by modifications made to the control circuit for additional inputs. It's purpose is to prevent the flow of electrical current through the electrical cable and, thus, the switching on of the power to the device being controlled, if the left hand is not on the secondary plate actuator.

For installation, the tool would be turned off and removed from its power source. The operator would remove the standard old handle from the tool or appliance and screw in or clamp or fasten the safety switch handle. The control box would be mounted on a suitable surface nearby in full view of the operator. The electrical cable would be routed from the handle to the front of the control box to be attached to the connector for the electronic control circuit that is located within the control box. The control box is plugged into a power source and the plug from the tool or appliance is plugged into the control box receptacle. The on button on the control box is turned on and the signaling device will operate. In operation, the operator is ready to operate and the product is placed upon the slicer, he or she will pull, push or slide the slicer mounted on/off switch and grip the safety handle and then squeeze the safety handle and begin operations. When the work has been completed, the safety handle is released which stops the slicer motor and, at this time, the original on/off switch mounted on the tool is turned off by the operator While we have described our invention in connection with specific embodiments thereof, it is clearly to be understood that this is done only by way of example and not as a limitation to the scope of our invention as set forth in the objects thereof and in the appended claims.

We claim:

1. A safety switch assembly, for use with power tools to control operating power to the power tool, comprising:

a control housing;

said control housing having an on-off power control switch positioned on said control housing;

said control housing further having apparatus control circuit means within said control housing;

said control housing having ground fault circuit interrupting means;

said control housing further having an electronic control means;

said control housing further having electrical power control means for permitting power to be directed from the electrical source to said power tool;

handle means;

said handle means having two force sensing resistors for detecting hand pressure and allowing electrical current to flow to said control circuit means;

said two force sensing resistors comprising variable resistance means for controlling said electrical current to flow from said handle means to said electronic control circuit means in said control housing which in turn permits electrical power to proceed through said electrical power control means to said power tool;

said handle means further having an electrical cable; and said electrical cable having means connecting said handle means to said control housing.

2. A safety switch assembly, according to claim 1, wherein: said ground fault interrupting means comprises a ground fault interrupter switch.

3. A safety switch assembly, according to claim 1, wherein:

said handle means having an egg shaped upper section;

said egg shaped upper section comprises a resilient material construction;

said handle means having a rigid lower section;

said rigid lower section comprises a rod like extension;

said rod like extension has attachment means to a base section; and said rod like extension further having stem means at said end opposite base attachment means.

4. A safety switch assembly, according to claim 3, wherein:

said two force sensing resistors have means for mounting upon said stem means of said rod like extension of said handle; and said mounting means comprises adhesive material.

5. A safety switch assembly, according to claim 1, wherein:

said control housing having signaling means; and said signaling means comprising a light that is illuminated when power is available to said control housing.

* * * * *